United States Patent [19]

Djordjevic et al.

[11] 4,267,808

[45] May 19, 1981

[54] CENTRIFUGAL RPM GOVERNOR FOR FUEL INJECTED ENGINES

[75] Inventors: Ilija Djordjevic; Ernst Ritter, both of Stuttgart, Fed. Rep. of Germany

[73] Assignee: Robert Bosch GmbH, Stuttgart, Fed. Rep. of Germany

[21] Appl. No.: 50,582

[22] Filed: Jun. 21, 1979

[30] Foreign Application Priority Data

Dec. 23, 1978 [DE] Fed. Rep. of Germany ..... 2855889

[51] Int. Cl.[3] ..... F02D 1/04

[52] U.S. Cl. ..... 123/367; 123/368; 123/364

[58] Field of Search ..... 123/140 R, 140 MC, 364, 123/365, 366, 367, 368

[56] References Cited

U.S. PATENT DOCUMENTS 4,143,634 3/1979 Ritter ..... 123/140 R 4,164,925 8/1979 Maier ..... 123/140 R

*Primary Examiner*—Charles J. Myhre

*Assistant Examiner*—Carl Stuart Miller

*Attorney, Agent, or Firm*—Edwin E. Greigg

[57] ABSTRACT

A centrifugal rpm governor is proposed for fuel injected internal combustion engines in which the full-load supply quantity is precisely settable at a fixed and invariable full-load setting and a predetermined constant pivot angle of the setting member actuated by the service lever. The governor includes an intermediate lever that is coupled with the supply quantity adjustment member of the injection pump, which intermediate lever is engaged both by a control member that is moved by flyweights in accordance with rpm and a setting member pivotable for the purpose of arbitrarily varying the supply quantity. The setting member and the control member both are articulated on the intermediate lever via a shift lever connecting both members, and the intermediate lever is provided with a pivotal bearing adjustable in the governor housing solely for the purpose of accomplishing the basic setting of the full-load supply quantity. The pivotal bearing serves simultaneously as a deflection member in order to prevent an overload of the control rod during an undergoverning situation.

4 Claims, 1 Drawing Figure

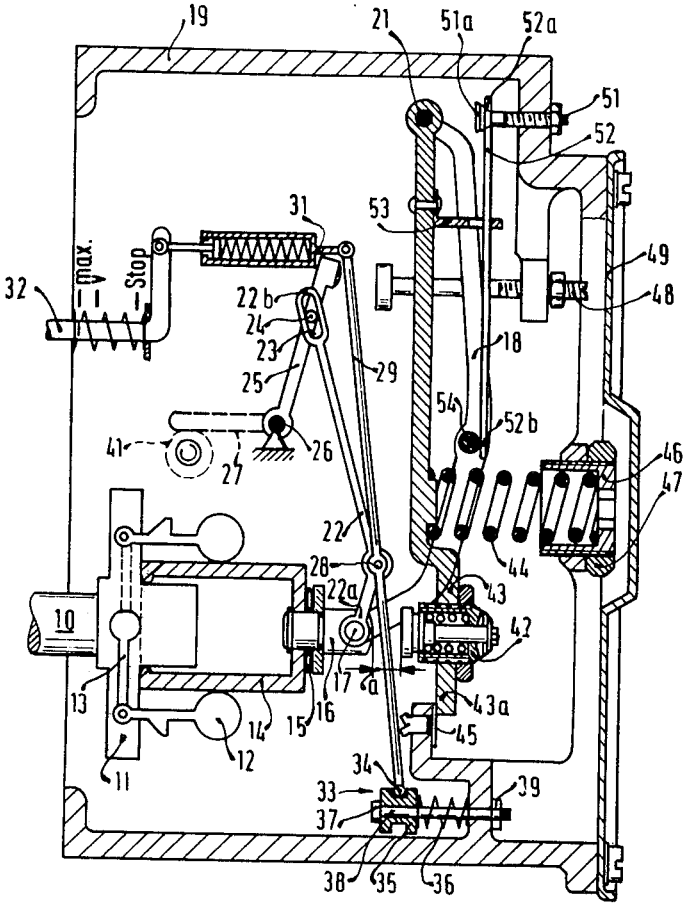
19
21
51a
52a
51
52
31
53
49
48
32
max.
Stop
22b
24
23
25
29
18
54
52b
41
27
26
46
47
22
28
22a
44
43
10
42
17
a
43a
13
14
15
16
45
12
11
34
33
39
37
38
35
36

CENTRIFUGAL RPM GOVERNOR FOR FUEL INJECTED ENGINES

BACKGROUND OF THE INVENTION

The invention relates to a centrifugal rpm governor for fuel injected internal combustion engines of a well known type. In known centrifugal rpm governors of this design (German Pat. No. 1,287,852 and Austrian Pat. No. 201,928), which are designed as idling and final rpm governors for Diesel engines, both the control member or sleeve is moved in accordance with rpm and a setting member pivotable for the purpose of arbitrary variation of the supply quantity engage, independently of each other, the intermediate lever being connected to the supply quantity adjustment member of the injection pump; and the articulation point of one of these control members at a particular time serves, upon adjustment of the other control member, as a momentary pivot point of the intermediate lever. The idling rpm and final rpm to be controlled are set by means of the adjustment of a support for the associated springs, and the associated idling supply quantity and full-load supply quantity can be set by means of adjustable stops for the two terminal positions of a service lever connected with the setting member. Because the governor parts cannot be manufactured without tolerance, the cited terminal positions of the service lever and the associated pivot angle, within a series of governors intended for identical use, are not identical. This varying position and above all the various pivot angles cannot be accepted when an automatic transmission is to be shifted in accordance with the service lever position, because for this purpose the engine manufacturer requires a pivot angle of the service or setting member of the governor to be always the same and to be set within narrow tolerances. Beyond this, there is the further requirement that in adjusting the idling sleeve path or the setting points for the rpm to be controlled and for the associated supply quantities, the other points which have already been set must not vary further. The above requirements cannot be fulfilled with the rpm governors of the prior art.

A centrifugal rpm governor of the structure generally referred to above has become known from the German Auslegeschrift No. 22 24 755, which has a stroke stop threaded into the supporting member and which serves to set the idling sleeve path, thus permitting a correction of the idling sleeve path without changing the position and prestressing of the control springs. The type of articulation of the setting member and the control member which is used in this governor and in the rpm governors mentioned at the outset, however, has the same disadvantages with respect to the non-constant pivot angle of the setting member.

OBJECT AND SUMMARY OF THE INVENTION

The centrifugal rpm governor as described herein and finally claimed has the advantage over the prior art that the position of the setting member and of the service lever coupled therewith is always identical in the full-load position, because corrections occasioned by tolerance or the necessary basic setting can be undertaken by means of the adjustable pivotal bearing of the intermediate lever. As a result, the full-load stop as well may be provided as a non-settable rigid stop, and when in addition the access point for the adjustment of the pivotal bearing is locked inside the governor housing and closed off by a cover, then an unauthorized adjustment of the full-load supply quantity is not possible.

Furthermore, when the full-load position is fixedly set, the tolerances affecting the idling setting are in a practical sense ineffective on account of the relatively long lever arms and the fixed rotary points of the levers involved. In addition, this invention reveals that the full-load setting and the pivot angle of the setting member can be kept constant within narrow limits, so that the pivot angle can be incorporated in an advantageous manner for generating a switching signal or switching path for automatic gears.

As a result of the features of the dependent claims, further advantageous embodiments and improvements of the centrifugal rpm governor of the main claim are possible. Thus, the pivotal bearing embodied in accordance with claim 3 acts simultaneously, in an advantageous manner, as a deflection member, which precludes an overloading of the governor parts during so-called "undergoverning". An undergoverning situation comes about, for instance, during overrunning with the setting member retracted to the idling position and with the supply quantity adjustment member located in the stop position, if the control member upon exceeding the terminal rpm performs the deregulation stroke against the force of the main control spring and then the supply quantity adjustment member tends to move out past the stop position.

In a centrifugal rpm governor which is particularly equipped with a stroke stop, known from the German Auslegeschrift No. 22 24 755, which serves to fix the idling sleeve path and is screwed into the supporting member, adjustment of the setting member can determine the idling supply quantity and is particularly advantageously fixed by means of an idling stop protected against unauthorized adjustment by being preferably disposed inside the governor housing. Thus, an unintended and unauthorized adjustment of the idling supply quantity is no longer possible, and by means of the stroke stop which is threaded into the supporting member, the idling sleeve path can be precisely set in a simple manner without influencing the previously set deregulation rpm, this idling sleeve path being required for the necessary load acceptance in idling control. As a result of the characteristics of claim 5, an unauthorized adjustment of the full-load quantity is entirely precluded and, in order to yield a switching signal or switching path for an automatic transmission, a constant adjustment angle of the setting member is always achievable, because a fine adjustment of the full-load setting of the supply quantity adjustment member can be undertaken by means of adjusting the pivotal bearing of the intermediate lever. The possibility for a narrow tolerance of the idling sleeve path, for its part, contributes to the fact that the predetermined tolerance for the pivot angle is not exceeded.

The invention will be better understood as well as further objects and advantages thereof become more apparent from the ensuing detailed description of a preferred embodiment taken in conjunction with the drawing.

BRIEF DESCRIPTION OF THE DRAWING

The single FIGURE of the drawing reveals a cross-sectional view of the improvements in centrifugal rpm governors.

DESCRIPTION OF THE PREFERRED EMBODIMENT

Turning now to the drawing of the structure disclosed, on the camshaft 10 of a known injection pump for internal combustion engines, which is not shown in further detail, there is secured a flyweight carrier 11 of a centrifugal rpm governor embodied as an idling and final rpm governor, on which carrier 11, flyweights 12 are supported in a pivotable manner. These flyweights 12, with pressure arms 13, engage a governor sleeve 14 which serves as the control member, and this in turn transmits the sleeve stroke effected by the flyweights 12 to a bolt 16 secured to the sleeve via a pressure bearing 15. The bolt 16 is articulated by means of a bearing tang 17 that is disposed on a guide lever 18, and which is pivotable on a bearing pin 21 secured in the governor housing 19 and thus guides the governor sleeve 14 in its stroke movements.

By means of the bearing tang 17, an end 22*a* of a shift lever 22 is also articulatedly connected with the sleeve bolt 16 of the governor sleeve 14, and another end 22*b* of this shift lever 22 is pivotably connected, by means of a slotted guide 23, with a pin 24 of a lever-like setting member 25. The setting member 25 is oscillatably secured on a lever shaft 26 supported as a pivot axis in the governor housing 19 and in turn also serves to support a service lever 27, shown in broken lines, that is located outside the governor housing. The shift lever 22 is connected via a bearing point 28 located between its two ends 22*a* and 22*b* with an intermediate lever 29 which serves as a control lever. The control lever is articulated at one end via an elastically yielding tongue 31 onto a control rod 32 which serves as the supply quantity adjustment member of the injection pump and is pivotably supported on the other end on a slidable bearing 33. This bearing member 33 comprises a sliding contact 35 which includes upstanding spaced shoulders between which is provided an annular groove that receives the bearing element 34 of the intermediate lever 29. The sliding contact 35 in its position of rest, as shown, is pressed by a deflection spring 36 against a head 37 of a setting screw 38 which functions as a stop. It will be understood that the screw 38 is adjustably secured in the governor housing 19. By adjustment of the setting screw 38, which is secured to the housing 19 by a nut 39, the bearing point 34 of the intermediate lever 29 is fixed in the axial direction of the governor sleeve 14 and can be changed by means of twisting the setting screw 38 for the purpose of making the basic setting of the full-load position of the control rod 32 which determines the full-load supply quantity, when, as is often desired by the engine manufacturer, the illustrated starting position and full-load position of the service lever 27 and thus of the setting member 25 is fixed by means of a full-load stop 41 that is attached to the housing and is not variable. The stop, in an advantageous manner, comprises a head 41 of a socket head cap screw, which is screwed firmly into the governor housing 19 parallel to the axis of the lever shaft 29 and offers no opportunity for adjustment.

The basic setting mentioned above may be undertaken when in the illustrated start and full-load position of the setting member 25 the engine is running at an rpm which ranges between the idling rpm and the final rpm, the governor sleeve 14 has covered an idling sleeve path distance designated by the letter "a", and the pressure bolt 16 then contacts an adapter capsule 42 which here serves as the stroke stop. The adapter capsule 42 is screwed into a force transmitting lever 43 which functions as a support member, which is pivotable about the bearing pin 21 and with its lower free end 43*a* is pressed by a main control spring 44 against a stop 45 that is attached to the housing. The initial stressing force of the main control spring 44 which functions as the final rpm control spring is determined by the position in which it is installed and can be readily set by means of a support 46 which comprises a threaded plug that is screwed into the governor housing 19. The threaded plug 46 is secured by means of a lock nut 47 in its set position and is disposed, like the stroke stop 42 and the setting screw 38 of the pivotal bearing 33 as well as an idling stop 48 embodied as a stop screw, within the governor housing 19 and is, like them, only accessible when a locking cover 49 is removed. This locking cover 49 that is sealed on the engine prevents the unauthorized adjustment of the above-noted stops and thus fulfills the requirements of vehicle manufacturers that the adjustment points on the governor which influence the exhaust gas values must be inaccessible, or be accessible only with extreme difficulty. The idling stop 48 must above all not be adjusted when in order to drive an automatic transmission the pivot angle of the setting member 25 is picked up from the lever shaft 26 or the service lever 27 and therefore is fixed at a predetermined angle within a tolerance prescribed by the engine manufacturer.

Only the setting screw 51 which is adapted for the correction of the idling rpm of the engine is located outside the housing portion closed off by the cover 49 and thus is also accessible in the case of the sealed governor when the cover is removed. This is particularly advantageous, and is necessary for the purpose of adapting the idling rpm to the varying internal friction of different engines. A head 51*a* of the setting screw 51 located inside the governor housing 19 acts as an adjustable support for an end 52*a* of an idling spring member 52 embodied as a leaf spring, which is supported on the force transmitting lever 43 via an angle bracket 53 which serves as a fixed support bearing or seat and with its terminal end 52*b* remote from the support 51*a* presses against a transverse bolt 54 that is disposed on the guide lever 18. By means of this transverse bolt 54, the initial stressing force of the idling spring 52 is transmitted onto the governor sleeve 14, and by means of the reaction force introduced via the support angle bracket 53 into the force transmitting lever 43 it is assured that the force of the idling spring 52 does not affect the final rpm, but rather is compensated for via the reaction force introduced into the force transmitting lever. For this reason, the setting screw 51 is also attached at approximately the same level as the bearing pin 21 which serves as the pivotal bearing for the force transmitting lever 43 and for the guide lever 48.

Deviating from known governors, in the described centrifugal rpm governor provided in accordance with the present invention both the setting member 25 and the governor sleeve 14 act via the shift lever 22 on the intermediate lever 29, and during adjustment movements on the part of the setting member 25 the bearing tang 17 acts as the pivot point at that moment for the shift lever 22, while during control movements on the part of the governor sleeve 14, the pin 24 on the setting member 25 performs the same function. During both kinds of actuation, the intermediate lever 29 is actuated via the bearing point 28 on the shift lever 22, whereupon the pivotal bearing 33 of the intermediate lever 29 represents the pivot point at that moment for the intermediate lever 29, which via the tongue 31 moves the control rod 32 in accordance with the amount of translation predetermined by the lever arms of the shift lever 22 and of the intermediate lever 29.

The sliding contact 35 of the pivotal bearing 33, which is elastically yielding as a result of the deflection spring 36, prevents an overload of the control rod during a so-called "under situation", because during overrunning of the engine, the instance, the intermediate lever 29, when the control rod 32 is already in the stop position, can deflect in the area of the pivotal bearing 33, when the governor sleeve 14 performs its deregulation stroke as a result of the excess rpm then occurring.

The foregoing relates to a preferred embodiment of the invention, it being understood that other embodiments and variants thereof are possible within the spirit and scope of the invention, the latter being defined by the appended claims.

What is claimed and desired to be secured by Letters Patent of the United States is:

1. A centrifugal rpm governor for fuel injected internal combustion engines including a housing, comprising an intermediate lever which is coupled with a supply quantity adjustment member of an injection pump which is engaged by both a control member moved by means of flyweights in accordance with rpm and a setting member which is pivotable for the purpose of arbitrary variation of the supply quantity, said governor further including a support member which contacts a stop attached to the housing under a prestressing force of a main control spring, said control member coming into effective contact with said support member after covering an idling sleeve path against the force of an idling spring, further wherein both said setting member and said control member are connected by a shift lever and are articulated via said shift lever on said intermediate lever, said shift lever includes opposite end portions, one end of said end portions being connected to said control member and the opposite end portion being connected with said setting member, said shift lever further being pivotably connected to said intermediate lever; said intermediate lever further provided with a pivotal bearing which is adjustable within the governor housing in a direction parallel with the movement of said control member for the purpose of accomplishing the basic setting of the full-load supply quantity.

2. A centrifugal rpm governor in accordance with claim 1, further wherein said pivotal bearing for said intermediate lever is formed by a sliding contact which contains a bearing point for said intermediate lever, said sliding contact further being arranged to be pressed against an adjustable stop means by a deflection spring.

3. A centrifugal rpm governor in accordance with claim 1, further wherein said setting member which determines the idling supply quantity is fixed by means of an idling stop means inside the governor housing and protected from unauthorized adjustment.

4. A centrifugal rpm governor in accordance with claim 3, further wherein said setting member is adapted for a constant adjustment angle by means of the preset idling stop attached to said housing.

* * * * *